US009790672B2

(12) United States Patent
McAlpine et al.

(10) Patent No.: US 9,790,672 B2
(45) Date of Patent: Oct. 17, 2017

(54) PLUMBING OVERFLOW

(71) Applicant: McAlpine & Co. Ltd., Hillington, Glasgow, Strathclyde (GB)

(72) Inventors: James Edward McAlpine, Paisley (GB); Christopher McKendrick, Glasgow (GB)

(73) Assignee: McAlpine & CO LTD., Glasgow (GB)

( * ) Notice: Subject to any disclaimer, the term of this patent is extended or adjusted under 35 U.S.C. 154(b) by 98 days.

(21) Appl. No.: 14/650,380

(22) PCT Filed: Dec. 3, 2013

(86) PCT No.: PCT/GB2013/053197

§ 371 (c)(1),
(2) Date: Jun. 8, 2015

(87) PCT Pub. No.: WO2014/087151

PCT Pub. Date: Jun. 12, 2014

(65) Prior Publication Data

US 2015/0299994 A1 Oct. 22, 2015

(30) Foreign Application Priority Data

Dec. 6, 2012 (GB) ..... 1221928.3

(51) Int. Cl.
*E03C 1/232* (2006.01)

(52) U.S. Cl.
CPC ..... *E03C 1/232* (2013.01)

(58) Field of Classification Search
CPC ..... E03C 1/232; E03C 1/24
USPC .... 4/679–682, 694; 137/153, 123, 142, 143, 137/145, 144, 247.49
See application file for complete search history.

(56) References Cited

U.S. PATENT DOCUMENTS 1,274,578 A * 8/1918 Nicholson ..... F04F 10/00 137/128
3,583,003 A * 6/1971 Thompson ..... E03C 1/284 285/302

FOREIGN PATENT DOCUMENTS

| | | | | |
|---|---|---|---|---|
| DE | AT 299824 B | * | 5/1972 | ..... E03C 1/232 |
| EP | 1484453 A1 | | 12/2004 | |
| EP | 1485453 A1 | | 12/2004 | |
| EP | 1593784 A2 | | 11/2005 | |
| EP | 1593784 A3 | | 11/2006 | |
| EP | 2045403 A1 | | 4/2009 | |
| EP | 2453065 A2 | | 5/2012 | |
| EP | 2453065 A3 | | 5/2012 | |
| IT | EP 2660398 | * | 11/2013 | ..... E03C 1/232 |

(Continued)

OTHER PUBLICATIONS

UKIPO Examination Report, GB1221928.3, dated Nov. 1, 2016.

(Continued)

*Primary Examiner* — Erin Deery
(74) *Attorney, Agent, or Firm* — Colby Nipper

(57) ABSTRACT

An overflow device for use with sinks and the like is described. The overflow device comprises a body adapted to be positioned adjacent the exterior of a sink bowl, the body having an inlet and an outlet joined by an inverted-U siphon passage, and a vent adapted to communicate ambient air to the top of the siphon passage, the vent being arranged to close when water level in the sink reaches a predetermined level. In at least one embodiment the vent has no moving parts.

16 Claims, 10 Drawing Sheets

(56) References Cited

FOREIGN PATENT DOCUMENTS

TR WO 2013184078 A1 * 12/2013 ..... E03C 1/232

OTHER PUBLICATIONS

UKIPO Examination Report, GB1510103.3, dated Nov. 1, 2016.
International Search Report and Written Opinion on International Application No. PCT/GB2013/053197, dated Mar. 11, 2014.

* cited by examiner

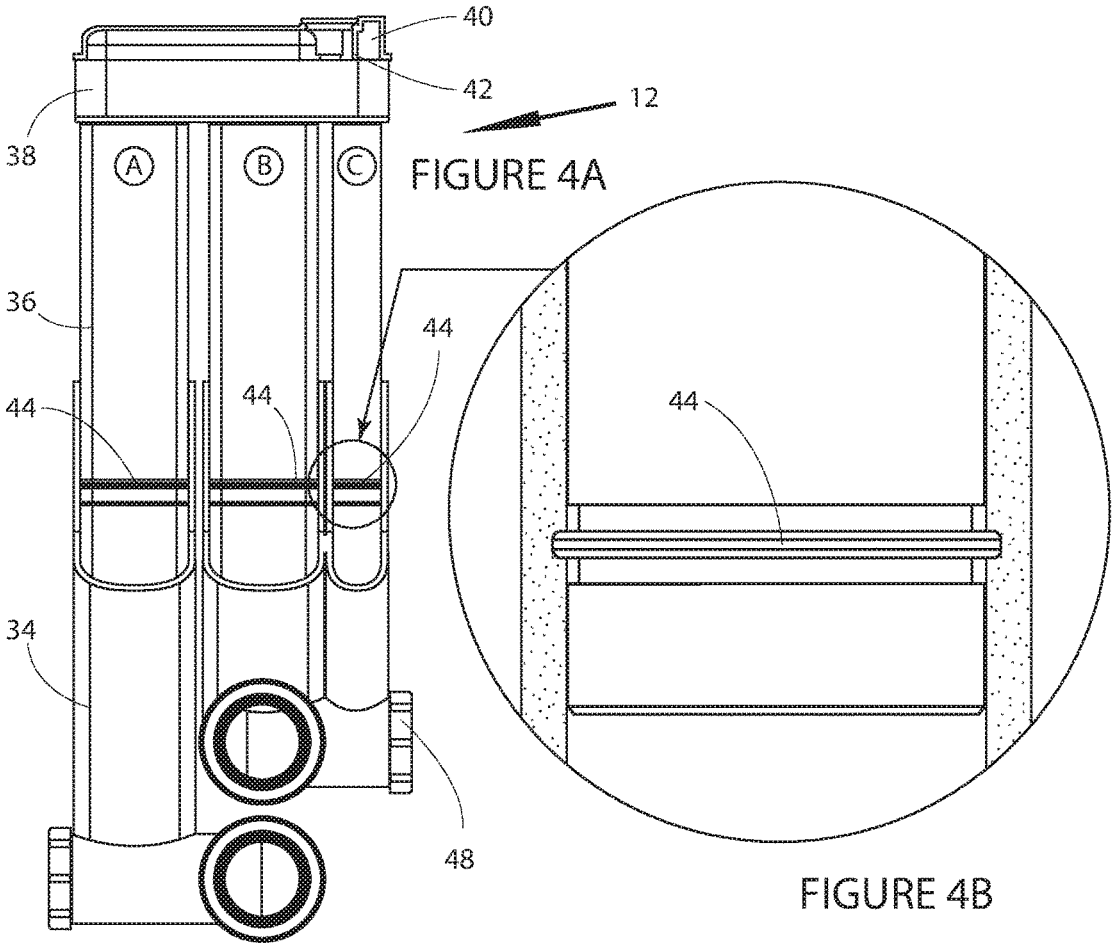
FIGURE 4A
FIGURE 4B
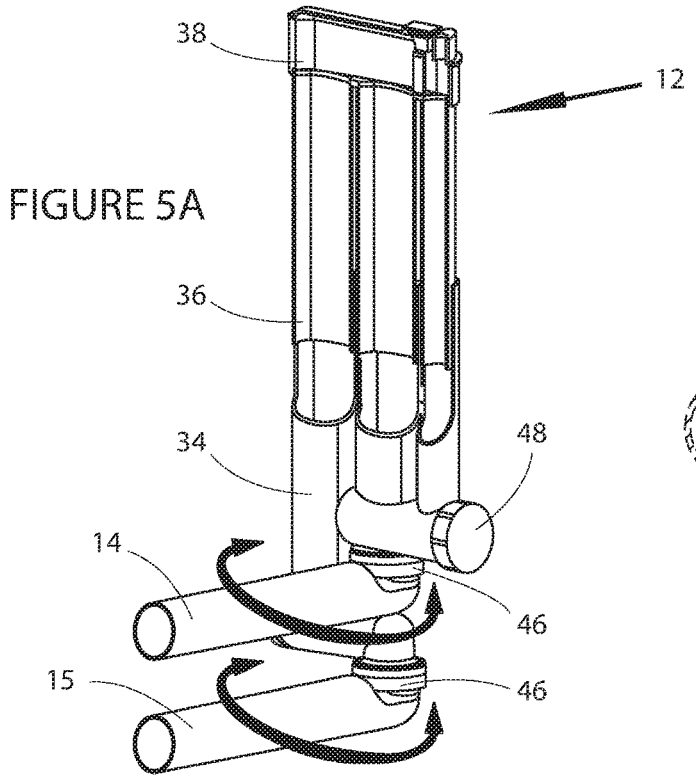
FIGURE 5A
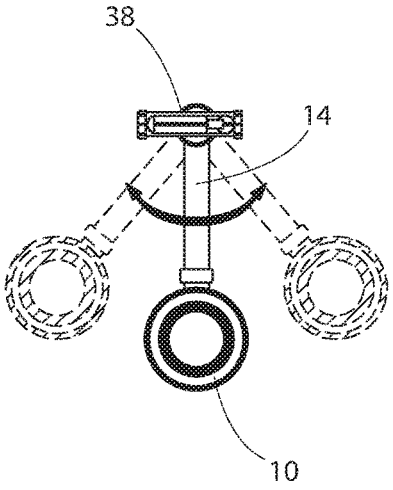
FIGURE 5B

PLUMBING OVERFLOW

FIELD OF THE INVENTION

This invention relates to a concealed overflow device for use with sinks and the like.

The invention will be particularly described herein with reference to sinks, but it is to be understood that the invention may be used with other plumbing installations such as basins and baths, and the expression "sinks and the like" is used herein to include all such applications.

BACKGROUND TO THE INVENTION

A sink conventionally has an overflow which determines the maximum level to which water can rise in the sink bowl. Usually, the overflow is in the form of an opening in the wall of the bowl, the opening being connected to the waste pipe either by means of a channel formed in the body of the sink itself or by means of a flexible hose interconnecting an overflow terminal and a terminal on the waste system.

Such overflow systems are simple and well understood, but they do have some disadvantages. An overflow channel within the sink body adds complexity to the structure and to the manufacturing process. A separate flexible hose arrangement uses a number of components and can be awkward to install and maintain. In addition, the waste opening in the wall of the sink bowl presents potential hygiene problems and can be difficult to clean.

It has hitherto been proposed to provide an overflow which is concealed, in the sense that there is no overflow opening in the wall of the bowl, and no overflow arrangement is visible to the user. Prior proposals, however, have relied on the use of valves in various forms, with consequent complexities in manufacture and potential reliability problems.

There is therefore a need for a concealed overflow arrangement of simple construction and operation.

SUMMARY OF THE INVENTION

Accordingly, the present invention provides an overflow device for use with sinks and the like, the overflow device comprising:

a body adapted to be positioned adjacent the exterior of a sink bowl, the body having an inlet and an outlet joined by an inverted-U siphon passage, and an air valve adapted to communicate ambient air to the top of the siphon passage, the air valve being arranged to close when water level in the sink reaches a predetermined level.

In at least one embodiment of the present invention, an overflow device is provided which can be fitted to two a sink, basin bath or the like and is adapted to selectively communicate air to a siphon passage permitting the overflow device to move between a siphonic state and a non-siphonic state, in the siphonic state the siphon draining the water out of the bath sink or basin or the like to below a predetermined level.

The inverted U-shaped siphon passage may comprise a first passage and a second passage, the first and second passages being divided by a passage member.

In a particularly preferred form of the invention, the air valve has no moving parts.

To this end, the air valve may comprise a vertical passage at the top of which is located an entry port separated from the top of the siphon passage by an inverted weir.

The air valve may comprise the entry port.

The entry port may be located on the overflow device body.

The body may define an upper portion, the upper portion in use defining the point of highest elevation of the overflow device. By this it is meant that when the overflow device is in a working position, the point of highest elevation is at or adjacent the maximum height water can rise to within the overflow device.

The entry port may be located on the body upper portion.

The entry port may be located at or adjacent the point of highest elevation of the overflow device.

The entry port may be located at or adjacent the highest elevation of the highest elevation point of the overflow device.

In use, the entry port may lie in a substantially horizontal plane.

In this embodiment, the entry port may be on an upper surface of the body.

The inverted weir may extend downwardly from the upper end of the vertical passage.

The inverted weir may extend downwardly such that the lowest point of the weir, in an in use configuration is below and upper end of the passage member. Such an arrangement ensures that the air valve is sealed by the rise of water prior to the water cascading over the passage member to establish siphonic flow conditions. If this was not the case then air would be admitted into the overflow device by the air valve prior to the establishment of a siphonic flow condition, potentially preventing the establishment of the condition.

The air valve may comprise an exit port, the exit port permitting air from the entry port to enter the siphon passage and breakdown siphonic flow.

The exit port may lie in a plane perpendicular to an entry port plane.

The entry port and the exit port may define a flowpath therebetween.

The flow path may be convoluted.

When the air valve is open, ambient air may be sucked through the entry port.

The body may further define a lower portion, the upper and lower body portions cooperating to define the inverted U-shaped siphon passage and the air valve vertical passage.

The upper and lower body portions are arranged telescopically.

In one embodiment, the upper and lower body portions are telescopically adjustable in height.

The upper and lower body portions may be sealingly connected. Sealingly connecting the upper and lower body portions prevents the egress of water from the overflow.

The body portions may be sealingly connected by a sealing arrangement.

The sealing arrangement may comprise a barrier.

The barrier may be a seal.

A barrier may be elastomeric seal. Alternatively or additionally, the barrier may be a gel or any type of sealing arrangement.

The elastomeric seal may be an O-ring seal. In other embodiments the elastomeric seal may be an edge seal.

One of said upper and lower body portions may be provided with integrally formed blade seals engaging with the other of said upper and lower body portions. This avoids the use of O-rings or the like.

The lower body portion may define the inlet and the outlet.

The inlet and outlet may be provided with swivel elbows to facilitate installation.

The overflow device may further comprise an air vent, the air vent adapted to vent air from the overflow device and/or pipework associated with overflow device.

From another aspect the invention provides a waste and overflow arrangement comprising a device as defined above in combination with a sink outlet waste fitting; the waste fitting having a sealing member movable between an open position allowing water to drain from the sink and a closed position retaining water within the sink; the waste fitting having a first fluid connection above the sealing member and a second fluid connection below the sealing member; the arrangement further comprising a first fluid conduit between the first fluid connection and the overflow device inlet and a second fluid conduit between the second fluid connection and the overflow device outlet.

Preferably the first and second fluid conduits are respective pipes and the first and second fluid connection and the overflow device inlet and outlet each comprises a pipe connector.

In certain embodiments, the waste fitting includes an air admission means in communication with the interior of the waste fitting below the sealing member.

A further aspect of the invention provides a waste fitting for use in the above arrangement, comprising a body adapted to be attached to a drain hole in a sink or the like; a sealing member movable within the body between an open position allowing water to drain from the sink and a closed position retaining water within the sink; the waste fitting having a first fluid connection above the sealing member and a second fluid connection below the sealing member.

In certain embodiments, the waste fitting includes a further connection below the sealing member for fitting an air admission means.

BRIEF DESCRIPTION OF THE DRAWINGS

Embodiments of the invention will now be described, by way of example, with reference to the drawings, in which:

FIG. 4 is a view similar to FIGS. 3A, 3B, 3C, 3D, 3E, and 3F showing a preferred sealing arrangement;

FIG. 5A is a perspective view of a modified embodiment;

FIG. 5B is a plan view corresponding to FIG. 5A; and

DESCRIPTION OF PREFERRED EMBODIMENTS

Figure 1:
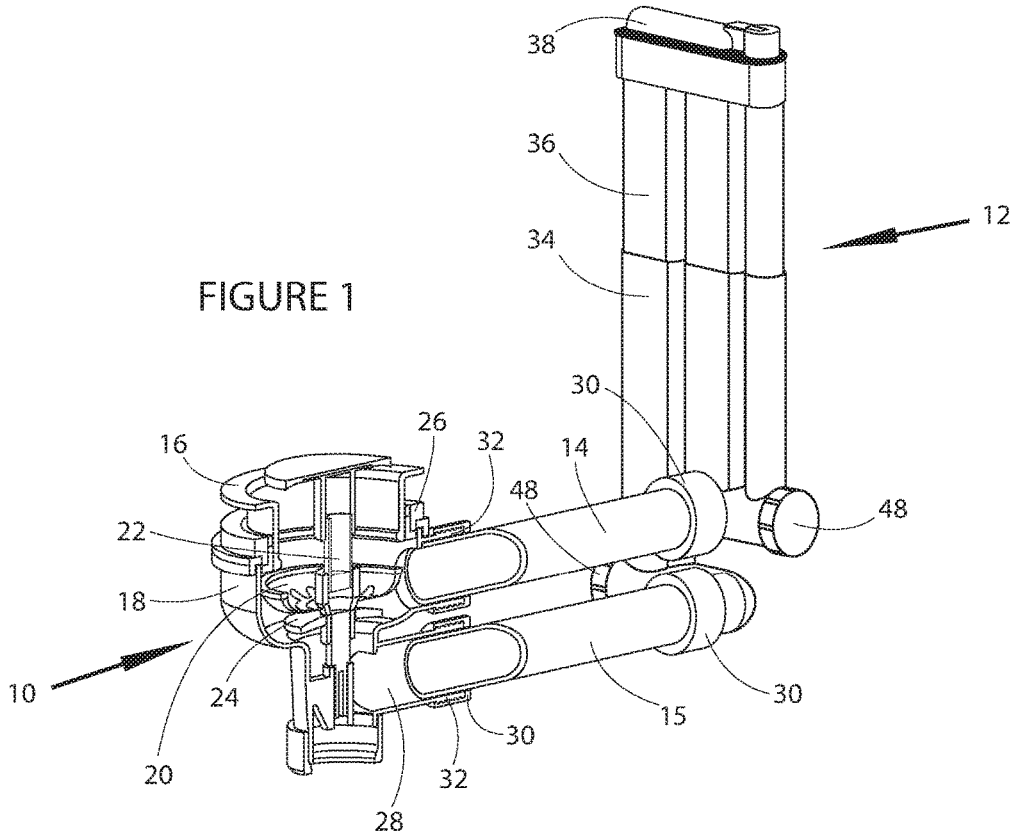
FIG. 1 is a perspective view of one embodiment of overflow arrangement according to the present invention.

Referring to FIG. 1, a waste and overflow assembly for a sink or the like comprises a waste fitting 10 and an overflow device 12 connected by two pipes 14 and 15.

The waste fitting 10 in this embodiment is of the type having a basket strainer and integral sealing plug, and comprises a flange 16 and an underbody 18 which screw together to engage with a sink opening. A strainer basket 20 is mounted on a movable stem 22 which also carries a sealing disc 24 which can be engaged against the underbody 18 to close the waste fitting 10.

The underbody 18 has a first boss 26 above the sealing disc 24 and a second boss 28 beneath the sealing disc 24, in which the pipes 14 and 15 are secured by backnuts 30 and seals 32.

The overflow device 12 comprises a lower body portion 34, a telescopic upper body portion 36 comprising a passageway portion 37 and a cap 38, and will be described in greater detail below. The lower body 34 is provided with removable covers 48 to allow access to clear blockages.

Figure 2A:
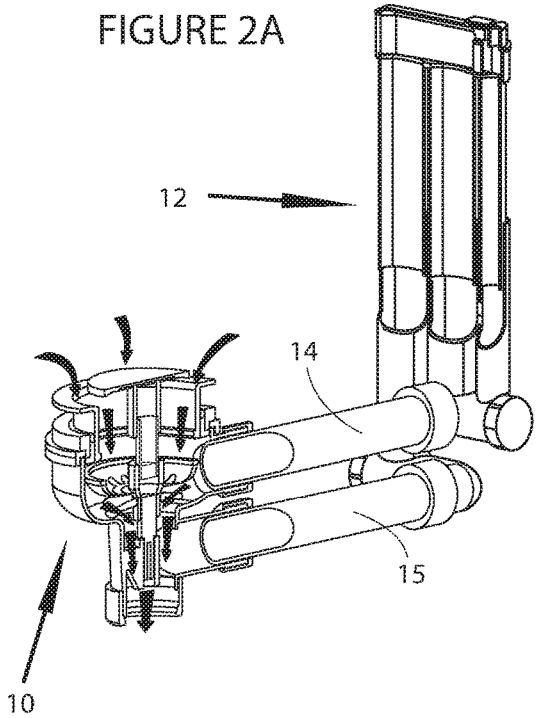
FIG. 2A is a similar view illustrating operation in a drain mode.
Figure 2B:
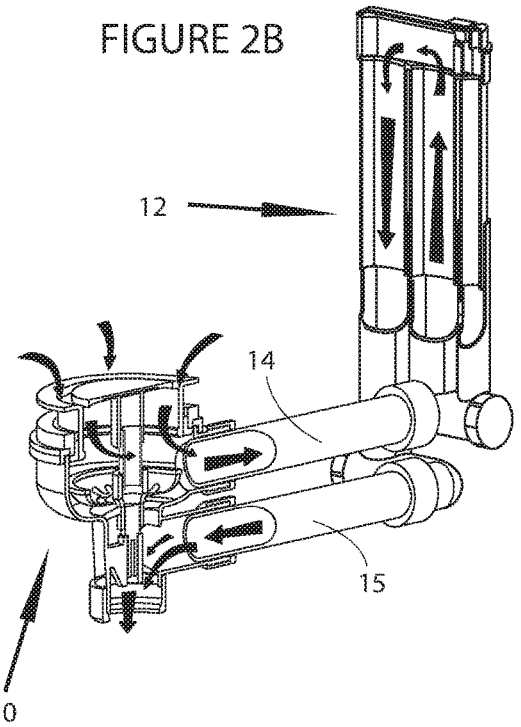
FIG. 2B is a similar view illustrating operation in an overflow mode.

FIG. 2A shows the overflow device 10 in a draining mode, in which the strainer basket 20 and sealing disc 24 are in a raised position. In this mode water in the sink passes directly to the drain. FIG. 2B shows the overflow device 10 in overflow mode. Here, the sealing disc 24 is engaged to retain water in the sink. If the water rises above a predetermined level in the sink it overflows via the pipes 14 and 15 and the overflow device 10 to drain beneath the sealing disc 24, as will now be explained more fully.

Referring to FIGS. 3A, 3B, 3C, 3D, 3E, and 3F, the lower body portion 34 and the upper body portion 36 together form three passages A 60, B 62 and C 64. Passages A 60 and B 62 are separated by a passage member 63 and together with an interior volume of the cap 38 form a siphon. Passage B 62 and passage C 64 are separated by a further passage member 65. Passage C 64 together with the remainder of the cap 38 form a non-mechanical air valve (i.e. a valve with no moving parts) having an air entry port 40 and an inverted weir 42. The inverted weir 42 extends downwardly from an upper end 66 of the passage C 64 such that its lowest point 68, in use, is below an upper end 70 of the further passage member 65. The sequence of events shown in FIGS. 3A, 3B, 3C, 3D, 3E, and 3F will now be described.

Figure 3:
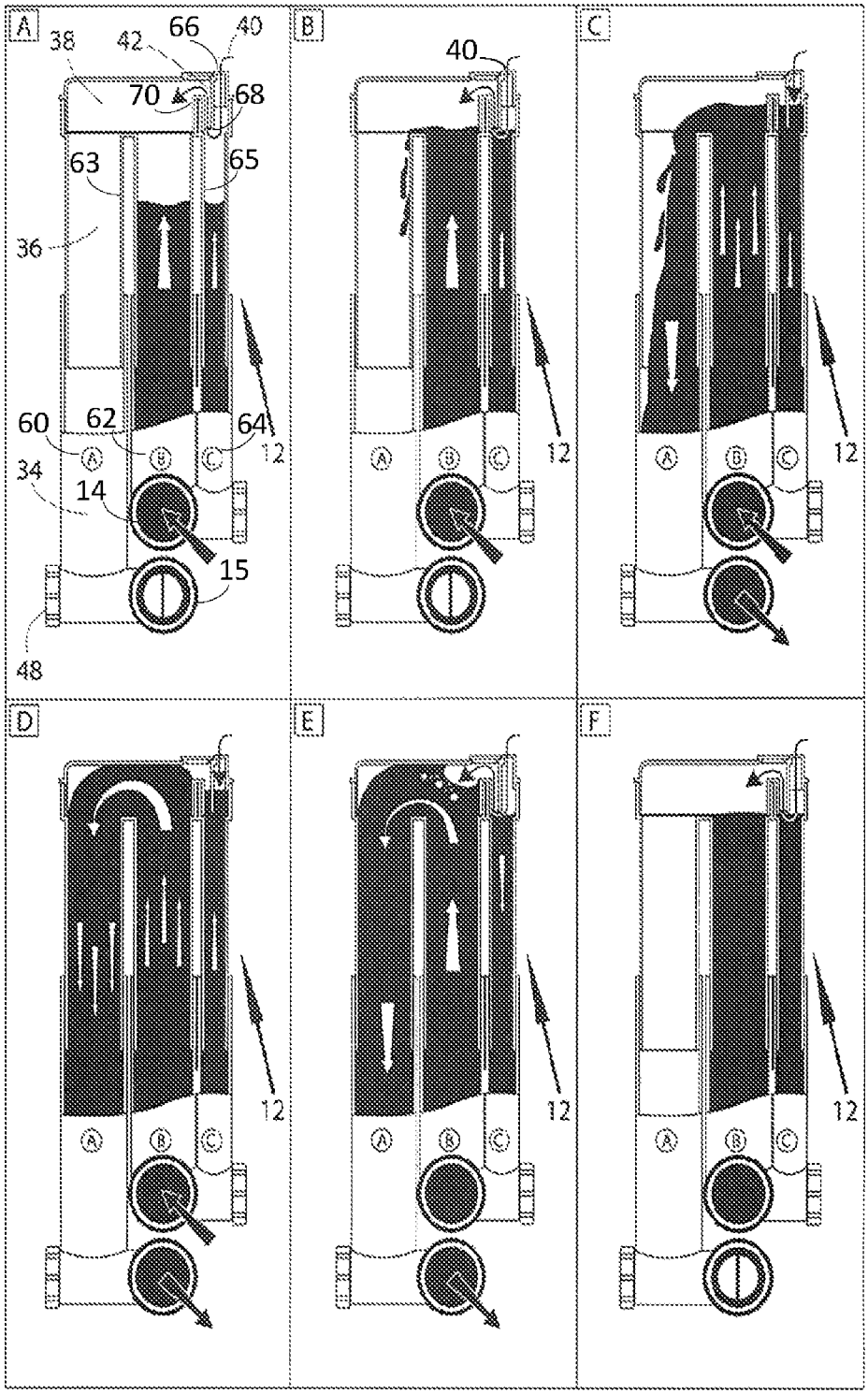
FIGS. 3A, 3B, 3C, 3D, 3E, and 3F show a front cross-sectional view of part of the apparatus, showing a sequence of operations.
Figure 3A:
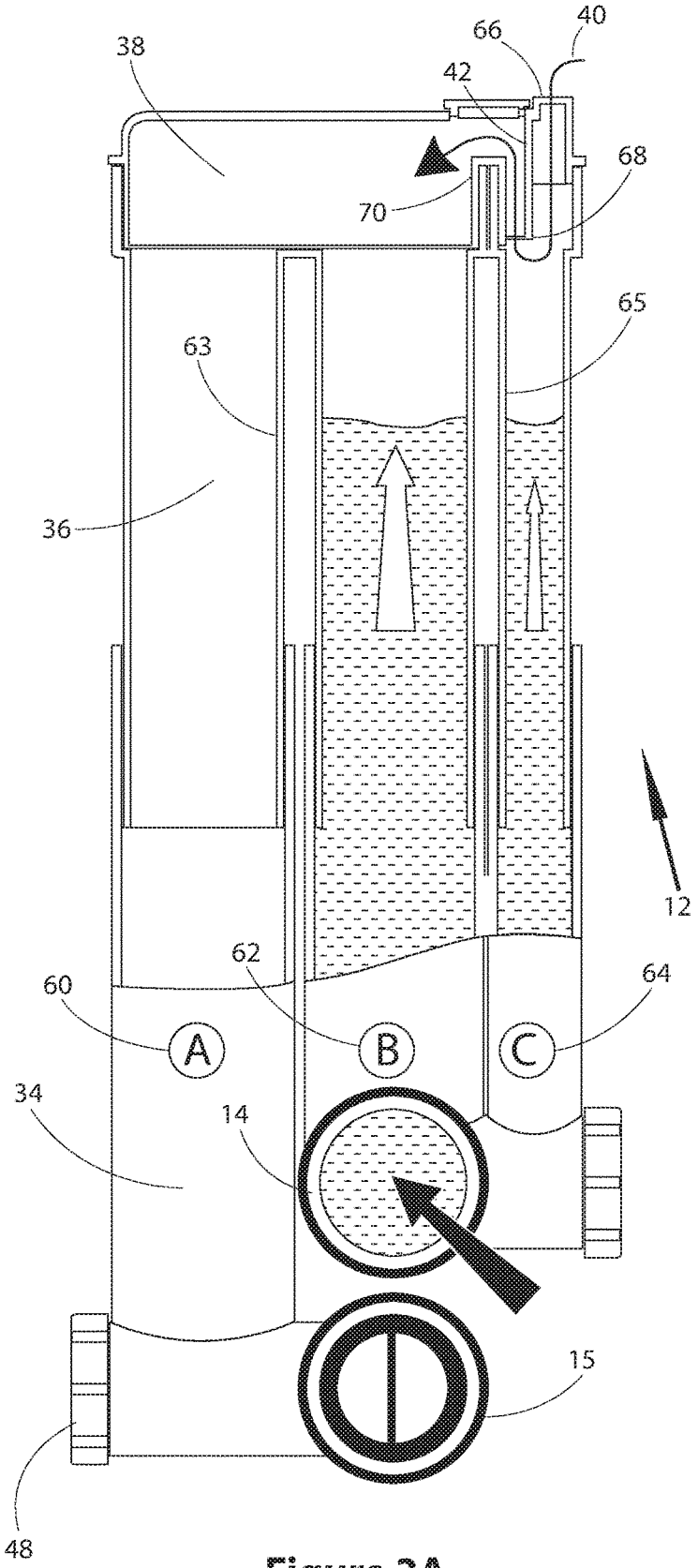
Figure 3B:
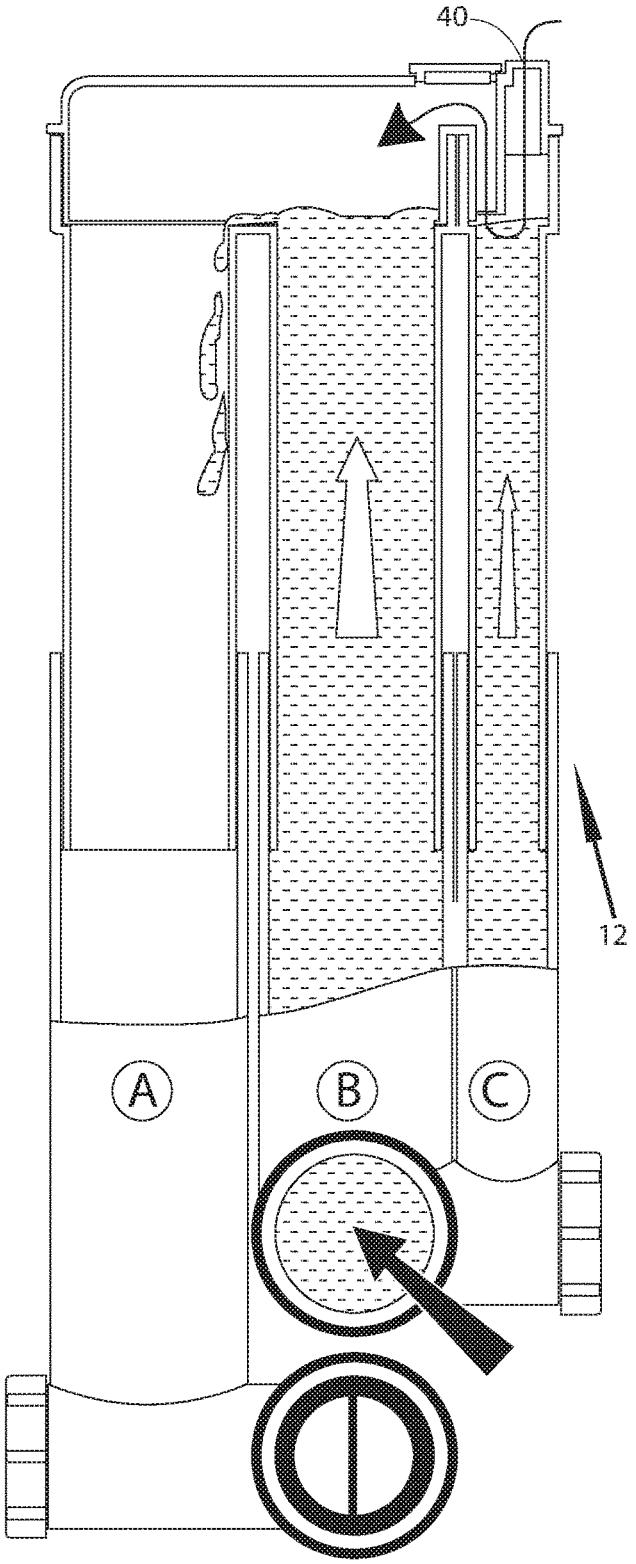
Figure 3C:
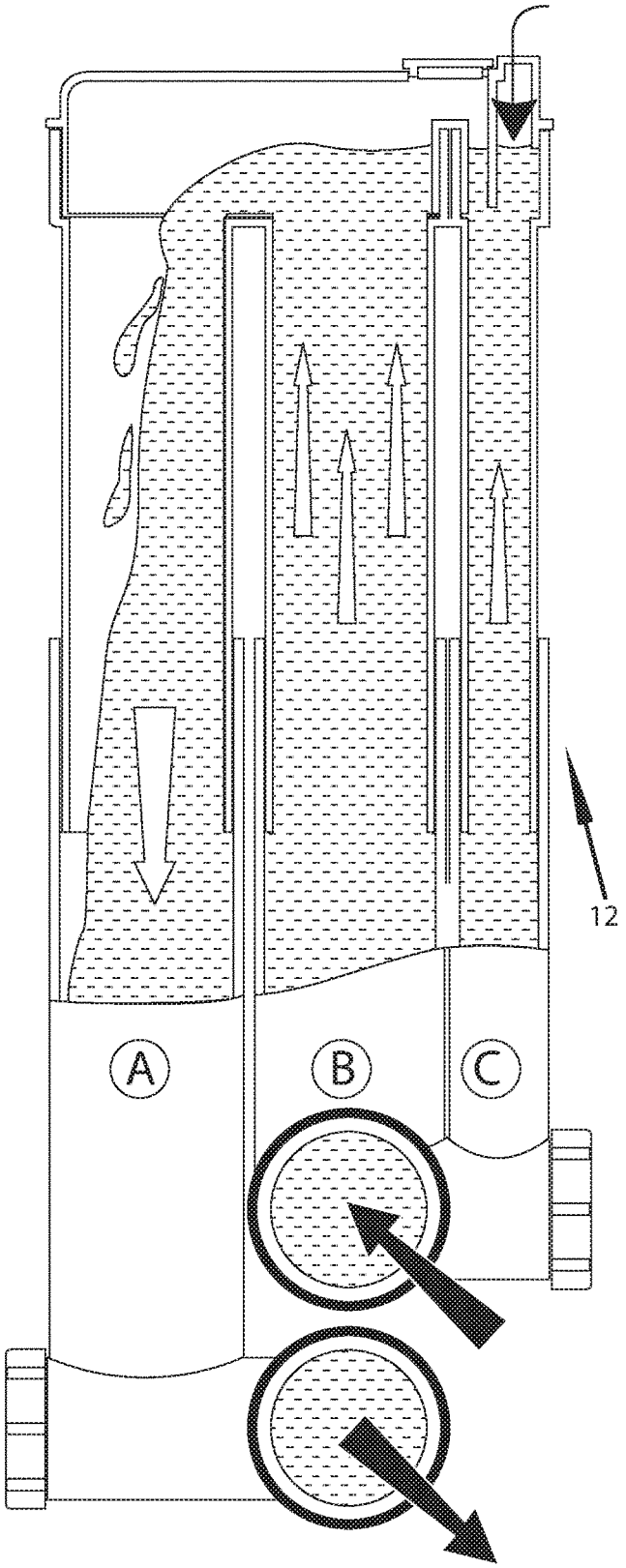
Figure 3D:
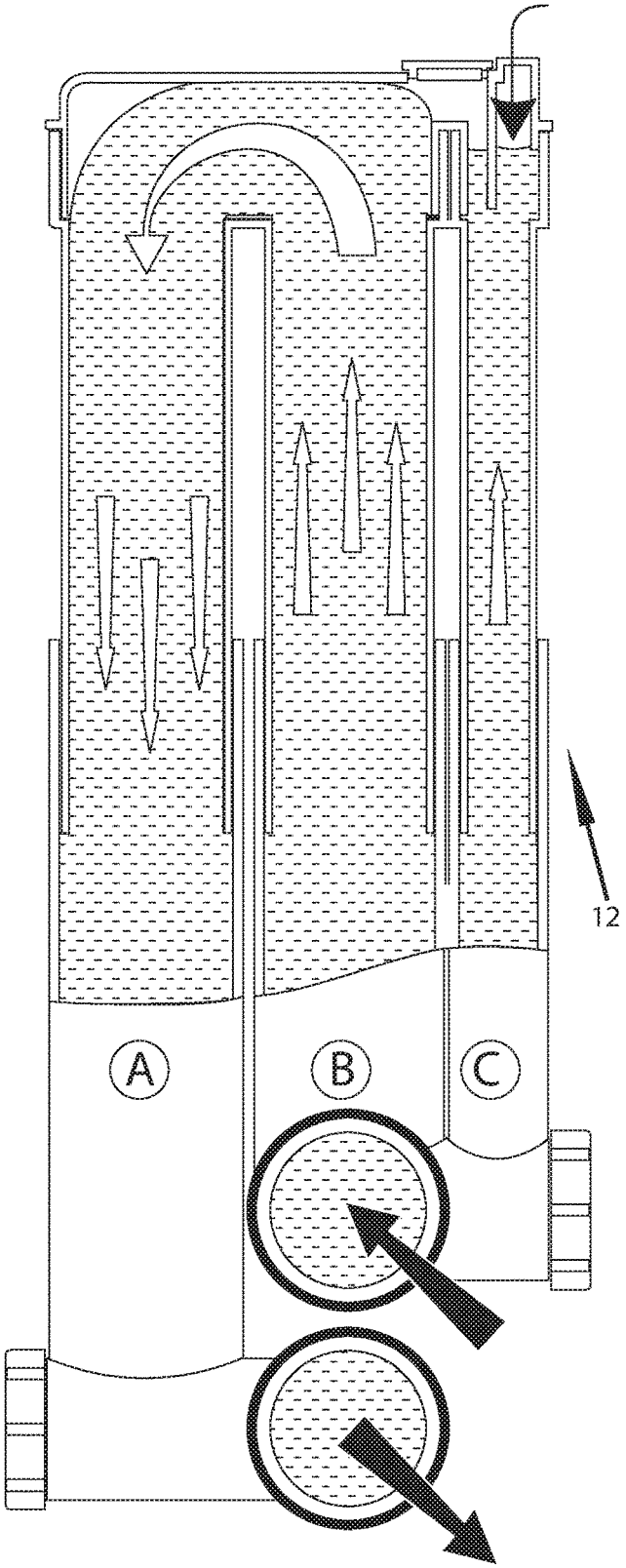
Figure 3E:
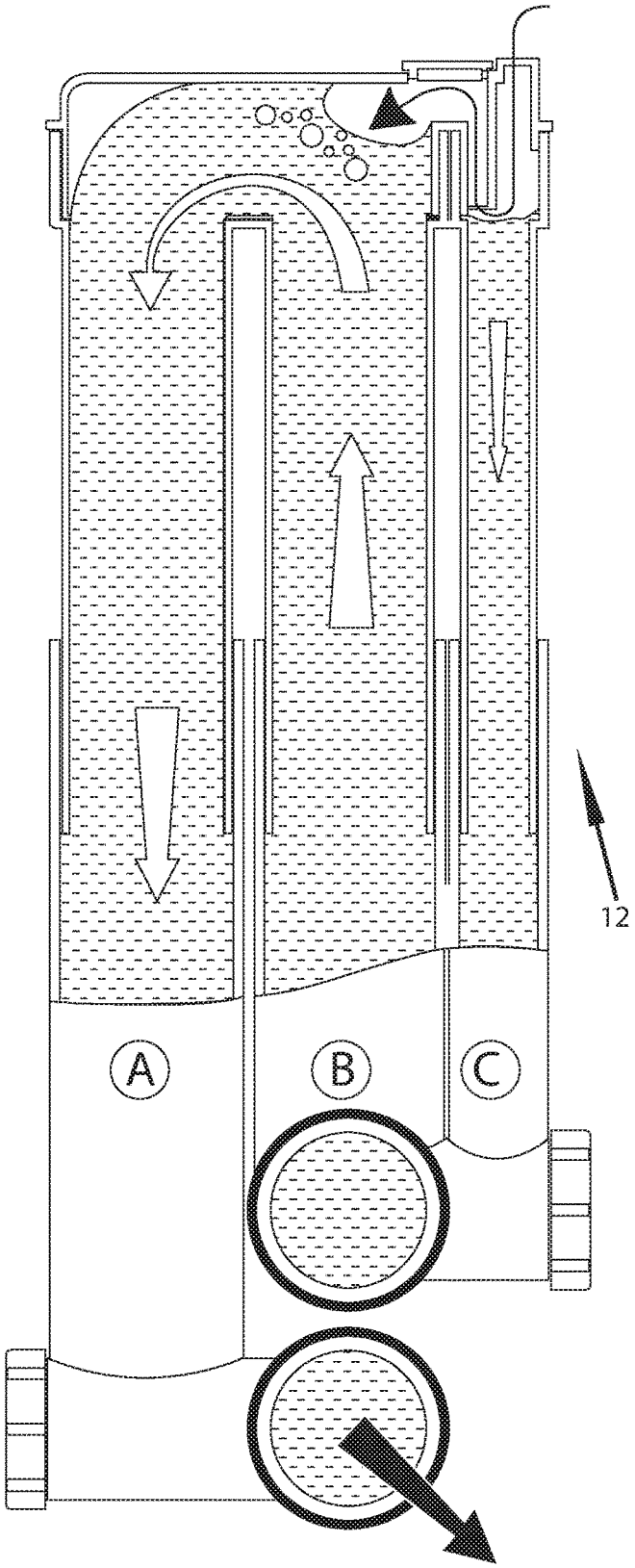
Figure 3F:
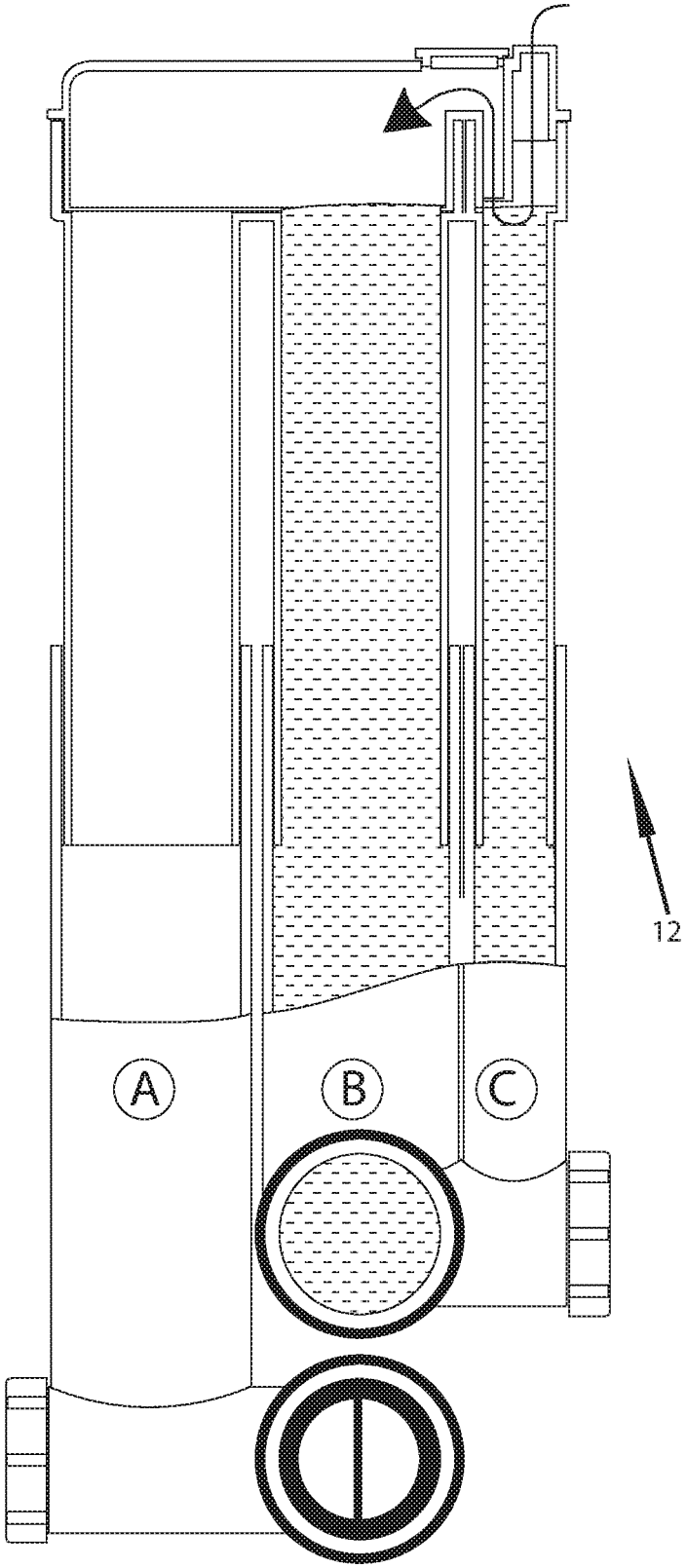

First the water level in passages B 62 and C 64 mirrors the level in the sink bowl (FIG. 3A). In FIG. 3B, the water level reaches the predetermined overflow level. Water begins to drain into passage A 60. The level in passage C 64 continues to match the level in the sink bowl. As the level in the sink bowl increases (seen in tube C 64), the air valve 40 is shut off. Drainage speed now increases due to the syphonic effect on the water in passage B 62. Referring to FIG. 3D, a syphon is fully formed and drainage speed increases to its maximum level (in a preferred example, 19 liters/min). Once the syphonic flow is set up the level in the basin sink bowl starts to drop, the level in passage C 64 dropping, continually matching the level in the sink bowl, allowing the air valve 40 to open (FIG. 3E). FIG. 3F shows air entering the overflow chamber, breaking the siphon.

It will be noted that both the feed pipe 14 and the return pipe 15 remain open at all times regardless of mode of operation. No valves are required in these parts.

Referring to FIG. 4, in the preferred embodiment the upper body 36 telescopes within the lower body 34 such that the height of the overflow device 12 is adjustable. The upper body 36 is moulded with blade seal rings 44 which eliminates the need for rubber seals such as O-rings. FIG. 4B shows the cross-section of the blade seal rings. In alternative forms of the invention, the telescopic adjustment may be dispensed with, and the overflow device 12 formed as a rigid unit of fixed length.

FIG. 5 shows a modified embodiment in which the pipes 14 and 15 are attached to the overflow device 12 via swivel elbows 46. This allows the assembly to be manoeuvred to avoid obstacles under the worktop such as taps or pipework. FIG. 5B indicates the range of angular variation which can be achieved.

The embodiments described above can suffer a problem when used with certain traps and U-bends in the downstream waste system, in that when the waste plug is closed an air bubble or air lock can form between the overflow device and the traps or U-bend, impeding or preventing flow from the overflow device. The embodiments of FIGS. 6 and 7 overcome this.

Figure 6:
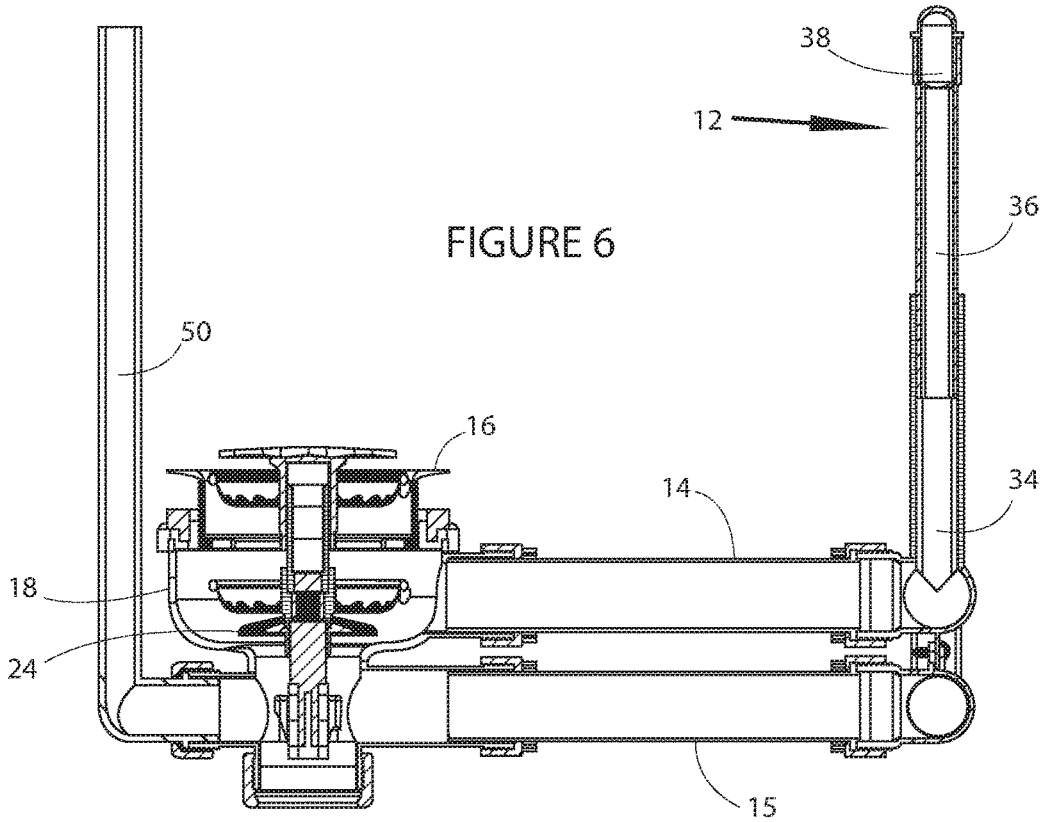
FIGS. 6 and 7 are cross-sectional views of further modified embodiments.

In FIG. 6, an air inlet is provided in the form of a standpipe 50 which admits air into the underbody 18 below the sealing disc 24, thus preventing the formation of an air bubble in the downstream waste system. The standpipe 50 extends above the level of the cap 38 to prevent overflow of water from it.

Figure 7:
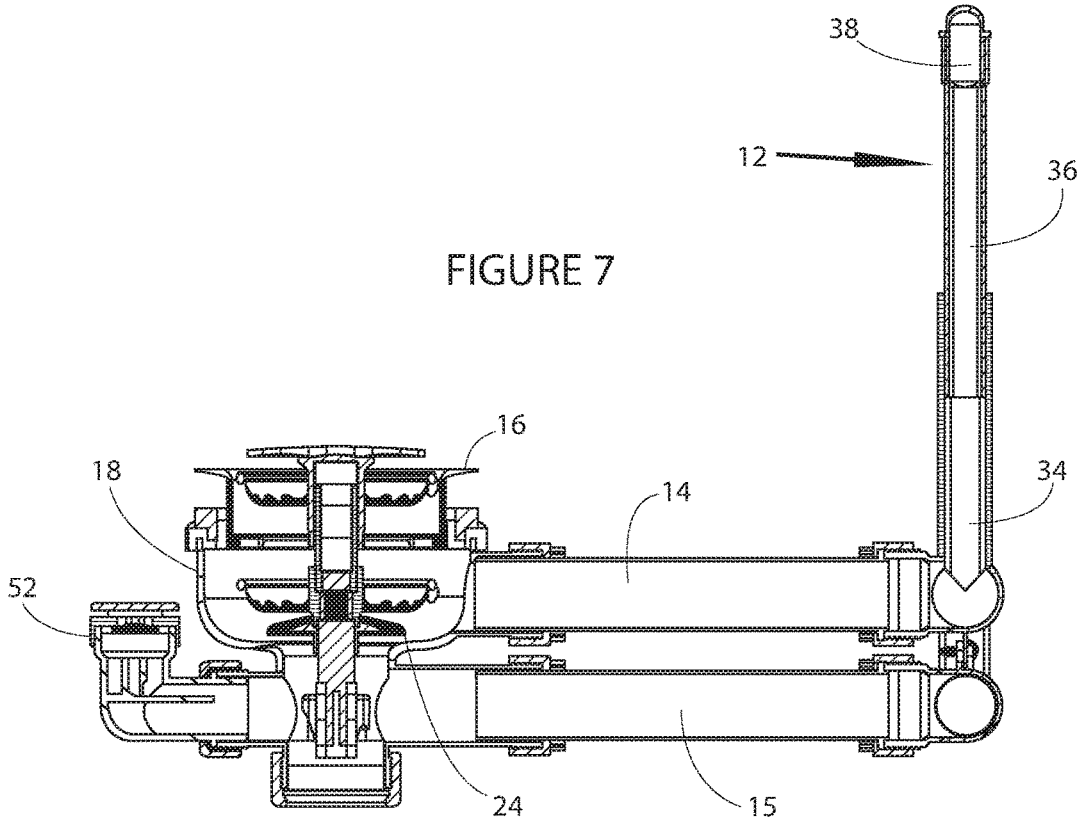

The same function is performed in FIG. 7 by a one-way air admission valve 52; such valves are well known per se.

The invention thus provides a concealed overflow arrangement which can be achieved without the use of moving parts and will thus be simple to manufacture and reliable in operation.

The invention claimed is:

1. An overflow device for use with a plumbing installation, a basin or a bath, the overflow device comprising:

a body adapted to be positioned adjacent an exterior of the plumbing installation, the body comprising a first passage, a second passage, a third passage, and a cap covering an upper end of each passage, wherein the first and second passages are divided by a first passage member and wherein the first and second passages together with an interior volume of the cap form an inverted-U shaped siphon passage, wherein the first and second passages define an inlet and an outlet joined by the inverted-U shaped siphon passage; and the third passage together with a part of the cap forms an air valve, wherein an upper portion of the cap defines an entry port, the entry port being separated from an upper end of the first and second passages by an inverted weir, wherein the inverted weir extends downwardly from an upper end of the third passage such that its lowest point is below an upper end of a second passage member dividing the third passage from the first and second passages, and wherein the air valve is operable to communicate ambient air to a top of the inverted U-shaped siphon passage and wherein the air valve is arranged to close when water level in the plumbing installation increases to a predetermined overflow level thereby creating a siphon effect and wherein the air valve is arranged to open when the water level in the plumbing installation decreases from the predetermined overflow level thereby breaking the siphon effect.

2. The overflow device of claim 1, wherein the air valve has no moving parts, wherein opening and closing the air valve is effected by water levels within the plumbing installation and the inverted U-shaped siphon passage.

3. The overflow device of claim 1, wherein the entry port is located on an upper portion of the cap at or adjacent a point of highest elevation of the overflow device.

4. The overflow device of claim 3, wherein the entry port is on an upper surface of the cap and lies in a substantially horizontal plane.

5. The overflow device of claim 1, wherein the air valve comprises an exit port defined by a space provided between an uppermost point of the second passage member and the weir, the exit port permitting air from the entry port to enter the inverted-U shaped siphon passage to breakdown siphonic flow.

6. The overflow device of claim 5, wherein the exit port lies in a plane perpendicular to an entry port plane.

7. The overflow device of claim 5, wherein the entry port and the exit port define a convoluted flowpath therebetween.

8. The overflow device of claim 1, wherein the body defines an upper body portion and a lower body portion, the upper and lower body portions being arranged telescopically and sealingly connected, and said upper and lower body portions cooperating to define the first, second, and third passages.

9. The overflow device of claim 8, wherein the lower body portion defines the inlet and the outlet.

10. The overflow device of claim 1, wherein the inlet and outlet are provided with swivel elbows to facilitate installation.

11. The overflow device of claim 1, wherein the overflow device further comprises an air vent, the air vent adapted to vent air from the overflow device and/or pipework associated with overflow device.

12. A waste and overflow arrangement comprising an overflow device as defined in claim 1 in combination with a sink outlet waste fitting; the waste fitting having a sealing member movable between an open position allowing water to drain from the sink and a closed position retaining water within the sink; the waste fitting having a first fluid connection above the sealing member and a second fluid connection below the sealing member; and the overflow arrangement further comprising a first fluid conduit between the first fluid connection and the inlet and a second fluid conduit between the second fluid connection and the outlet.

13. The waste and overflow arrangement of claim 12, wherein the first and second fluid conduits are respective pipes and the first and second fluid connection and the inlet and outlet each comprises a pipe connector.

14. The waste and overflow arrangement of claim 12, wherein the waste fitting includes an air vent in communication with an interior of the waste fitting below the sealing member.

15. The waste and overflow arrangement of claim 12, wherein the body is adapted to be attached to a drain hole in a sink; and said sealing member is movable within the body between an open position allowing water to drain from the sink and a closed position retaining water within the sink.

16. The waste fitting of claim 15, wherein the waste fitting includes a connection below the sealing member for fitting an air vent means.

* * * * *